US006463254B1

(12) United States Patent
Maul et al.

(10) Patent No.: US 6,463,254 B1
(45) Date of Patent: Oct. 8, 2002

(54) TONER CLEANER SYSTEM VIBRATOR AND METHOD

(75) Inventors: Michael David Maul, Lexington, KY (US); Alexander Douglas Meade, Lexington, KY (US); Liqun Larry Wang, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 09/851,716

(22) Filed: May 9, 2001

(51) Int. Cl.[7] ..... G03G 21/10
(52) U.S. Cl. ..... 399/350; 399/358
(58) Field of Search ..... 399/350, 351, 399/358, 360; 15/256.5, 256.51

(56) References Cited

U.S. PATENT DOCUMENTS

| | | | | |
|---|---|---|---|---|
| 3,740,789 A | | 6/1973 | Ticknor | |
| 4,007,982 A | | 2/1977 | Stange | |
| 4,111,545 A | | 9/1978 | Meltzer | |
| 4,111,546 A | | 9/1978 | Maret | |
| 4,218,132 A | | 8/1980 | Iwai et al. | |
| 4,297,026 A | * | 10/1981 | Honda et al. | 399/350 X |
| 4,505,577 A | | 3/1985 | Koizumi | |
| 4,518,248 A | | 5/1985 | Nishikawa | |
| 4,659,212 A | * | 4/1987 | Ichihara et al. | 399/358 |
| 4,982,240 A | | 1/1991 | Nakano | |
| 6,055,404 A | | 4/2000 | Yamazaki et al. | |
| 6,055,405 A | | 4/2000 | Knott et al. | |
| 6,108,511 A | | 8/2000 | Kutsuwada et al. | |

* cited by examiner

*Primary Examiner*—William J. Royer
(74) *Attorney, Agent, or Firm*—Todd T. Taylor; Taylor & Aust, P.C.

(57) ABSTRACT

A toner cleaning apparatus for a printing device includes a toner separator operating against a component of the printing device, to dislodge toner particles therefrom. A toner receptacle is provided for collecting the dislodged toner particles, and an auger positively conveys the dislodged toner particles into the toner receptacle. A vibration plate is provided for receiving the toner particles dislodged by the toner separator, and for directing the dislodged toner particles to the auger. The vibration plate includes lengths thereof extending into the auger and deflected by the auger to induce vibrations along the plate and distribute-and convey toner particles disposed thereon.

26 Claims, 2 Drawing Sheets

TONER CLEANER SYSTEM VIBRATOR AND METHOD

BACKGROUND OF THE INVENTION

1. Field of the Invention

The present invention relates to toner cleaning systems in electrophotographic printing devices for removing residual toner from device components, and, more particularly, to an agitation system for improving toner transport through the cleaning system.

2. Description of the Related Art

A printing device, such as a laser printer or copier, using the electrophotographic process includes a photosensitive member, such as a photoconductive drum, which is uniformly charged over the surface thereof. A latent image is electrostatically formed by selectively exposing the uniformly charged surface of the photosensitive member. Microscopic marking particles, known as toner, are applied to the electrostatic latent image, and subsequently transferred to the media intended to receive the final, permanent image. The toner image is fixed to the media by the application of heat and pressure in a fuser.

The design and implementation of an electrophotographic process in a printing device requires the handling of toner through a variety of different systems, in order to deliver a solid image to the media. The surfaces of the various components contacting toner within the different systems often require cleaning to remove residual amounts of toner resulting from film splitting, residual charges on the surfaces and the general characteristics of the toner. If not removed, the residual toner on component surfaces can adversely affect the quality of subsequent print jobs.

Current applications are known to use a scraping blade located against a surface to be cleaned in an electrophotographic apparatus, to peel the toner from the belt, roll, or other surface. Another known method to clean surfaces in an electrophotographic apparatus, is to utilize a cleaning web which is located and indexed against the rotating surface, to remove the toner from the surface. A cleaning web system consists of a supply spool, take up spool, nip forming roll and one or more idle rolls. The web material is brought into contact with the electrophotographic component via a spring loaded biasing roll, and the web is driven during the machine operation in order to remove contamination from the surface it contacts. Although both concepts work to some degree, the use of a cleaning web tends to require a large amount of hardware, which is more costly than a blade-type system.

However, the implementation of a blade cleaning system is also difficult, due at least in part to the properties of the toner itself. As the toner is removed from the EP component, the toner must be moved some distance to a waste container provided for receiving and containing the toner. The qualities of the toner generally make the driving of the toner difficult, due to the tendency of toner to adhere to any surface it contacts within the cleaning system, as well as for the toner to adhere to itself in clumps. Therefore, the toner must be driven from the point of contact with the cleaning system, through the system to an auger and then into the waste container in which it is received.

Cleaning systems are known to use the force generated by incoming toner, to push toner through the cleaner system housing and into an augering system. Difficulties can be encountered in a toner driven system, in that the toner may be pushed in unintended directions, as a result of the tendency of the toner to cling to surfaces and clump to itself.

Toner leakage can occur, or toner may bypass the cleaning system all together. Additionally, due to the tendency of the toner to clump, the system must be able to handle large toner dumps that may occur if a large clump reaches the auger. If designed to handle a large toner dump, the system may be over designed for normal routine operation. If not designed to handle a large enough toner dump, leakage and other problems can occur. Further, the system must be designed to handle the back pressure generated by toner already in the housing and to handle stress on the components generated by the force of the toner.

What is needed is an improved system and apparatus for moving the toner from the point at which the toner is removed from a printer component to the auger, which positively transports the toner toward the waste container.

SUMMARY OF THE INVENTION

The present invention provides a simple, yet reliable mechanism for transporting toner through a toner cleaning system.

The invention comprises, in one form thereof, a toner cleaning apparatus for removing toner from a toner receiving surface of a component of a printing device. The toner cleaning apparatus has a toner separator operating against the component surface, to dislodge toner particles therefrom, a toner receptacle for collecting the dislodged toner particles, and an auger for transporting dislodged toner particles to the toner receptacle. A vibration plate is disposed for receiving toner particles dislodged by the toner separator and for directing dislodged toner particles to the auger. The vibration plate includes a receiving edge and a discharge edge, the discharge edge having first lengths thereof engaged by the auger, and second lengths thereof spaced from the auger.

The invention comprises, in another form thereof, a method for cleaning toner from a component of a printing device, comprising providing a toner separating device and an auger; providing a vibration plate having a receiving edge and a discharge edge, and providing the discharge edge of the vibration plate with first portions and second portions, the second portions being nearer to the receiving edge than are the first portions; operating the separator against the component to dislodge toner from the component; receiving dislodged toner on the vibration plate near the receiving edge; vibrating the vibration plate through engagement of the first portions by the auger; discharging toner into the auger along the second portions of the discharge edge of the vibration plate.

The invention comprises, in still another form thereof, a printing device with a printing station including a printhead having a toner receiving component. A toner separator operates against the component surface, to dislodge toner particles therefrom. A toner receptacle collects the dislodged toner particles, and an auger transports dislodged toner particles to the toner receptacle. A vibration plate is disposed for receiving toner particles dislodged by the toner separator, and for directing dislodged toner particles to the auger. The vibration plate includes a receiving edge and a discharge edge, the discharge edge having first lengths thereof engaged by the auger, and second lengths thereof spaced from the auger.

An advantage of the present invention is providing a mechanically simple and operationally reliable mechanism for positively transporting toner through a toner cleaning apparatus.

Another advantage is providing a transport mechanism that tends to break up and dislodge toner clumps, and minimizes the tendency of toner to adhere to the surface of the toner transporting mechanism.

Yet another advantage is providing a toner cleaning apparatus that reduces toner dumps, allowing reduced sizing of the apparatus, and reduced installation cost for the apparatus.

BRIEF DESCRIPTION OF THE DRAWINGS

The above-mentioned and other features and advantages of this invention, and the manner of attaining them, will become more apparent and the invention will be better understood by reference to the following description of an embodiment of the invention, taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
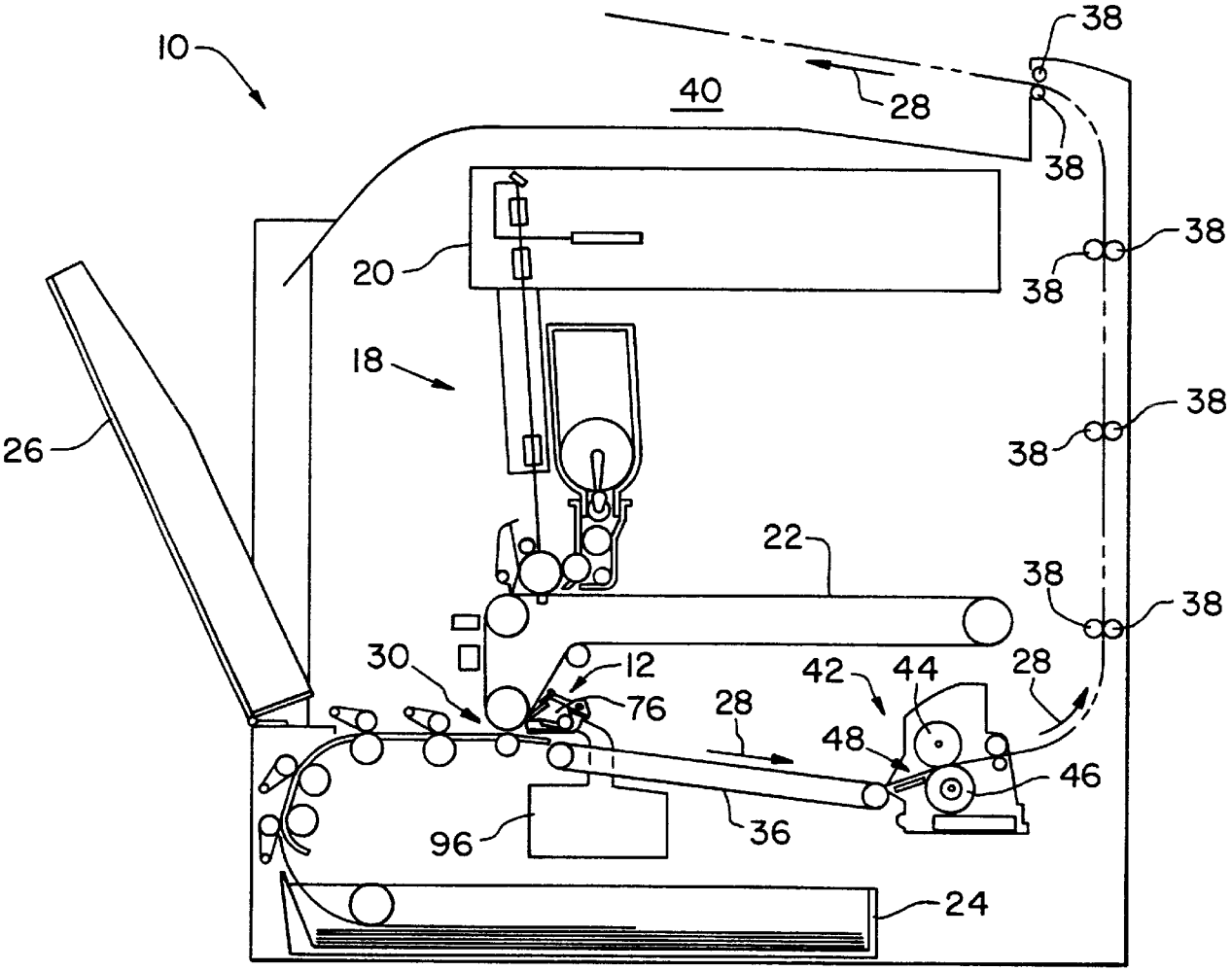
FIG. 1 is a simplified schematic representation of a laser printer in which the present invention may be utilized advantageously.

Referring now to the drawings, and particularly to FIG. 1, there is shown a printing device 10, in the form of a laser printer, in which a toner cleaning apparatus 12 having an agitation system 14 (FIG. 2) of the present invention may be used advantageously.

It should be understood that the laser printer shown in FIG. 1 is merely one type of printing device 10 in which the present invention may be used advantageously. Other types of printing devices, including other types and configurations of laser printers, copy machines, facsimile machines or the like may readily employ use of the present invention, to achieve the advantages incumbent therein. The particular embodiment of the laser printer shown in FIG. 1 should not be construed as a limitation on the use and application of the present invention, nor on the scope of the claims to follow.

The general structure of a laser printer, and the operation of the electrophotographic process used therein, will be readily understood by individuals skilled in the art, and will not be described in detail herein. For reference purposes in describing the present invention, in FIG. 1 a laser printing station 18, including a printhead 20, is shown, which creates an electrostatic image in known fashion on a photosensitive member. Toner is applied to the electrostatic image. It should be understood that in a non-color printer only one printhead may be used; however, in a color printer separate printheads for black, magenta, cyan and yellow toners may be used. The toner image is created on a photoconductive drum and/or image transfer belt 22, and thereafter transferred to the selected media. The media, such as paper or the like, on which the image is to be printed, is provided from one or more media supply trays 24, 26, two such media supply trays 24, 26 being shown in FIG. 1. The media follows a media path, indicated by the arrows 28, from tray 24 or tray 26 through an image transfer nip 30, at which the image is transferred from image transfer belt 22 to the media. Printing device 10 may include a duplexer (not shown) in which the media sheet is reversed and inverted, for presenting the opposite side of the media to image transfer nip 30, in proper orientation for receiving an image on the second side of the sheet, after an image has been formed on the first side of the sheet. Media path 28 includes a series of guide surfaces or belt 36, and guide rolls 38 to direct the media through device 10. A printed media receiving zone 40 is provided at the end of media path 28, to accumulated the completed pieces of printed media.

To fix the toner image on the media, a fuser 42 is provided, to apply heat and pressure to the image on the media, thereby causing the toner to melt and flow into the pores or interstices of the media. Fuser 42 includes a hot roll 44 and a backing roll 46 disposed in nipped surface contact, creating a fuser nip 48 through which the media passes.

Figure 2:
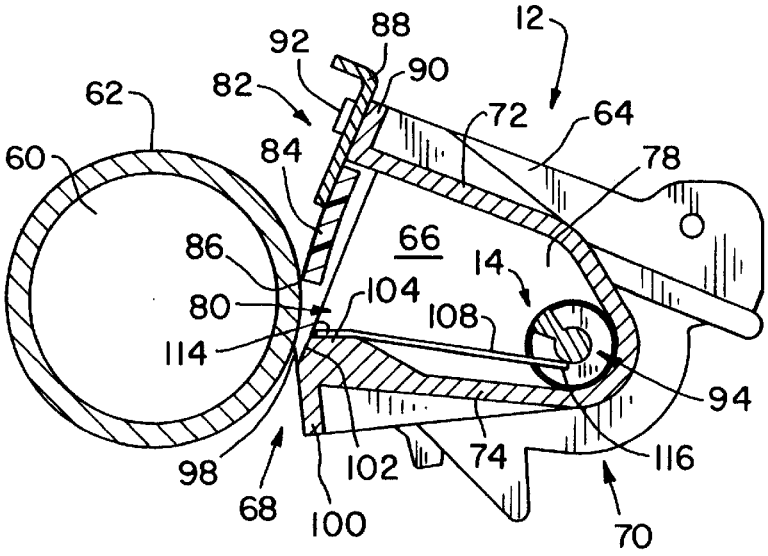
FIG. 2 is a cross-sectional view of a toner cleaning apparatus embodying the present invention.

Referring now to FIG. 2, toner cleaning apparatus 12 is shown operating on a toner receiving component 60 of printing device 10. For printing device 10 shown in FIG. 1, toner receiving component 60 may be image transfer belt 22. In other printing devices, toner receiving component 60 may be a photoconductive drum or other component of printing station 18 which receives, deposits, or otherwise handles toner during the printing process. Toner receiving component 60 has a surface 62 on which toner is received and from which excess or residual toner is to be removed.

Toner cleaning apparatus 12 includes a housing 64 defining an enclosed interior space 66 for receiving, containing and handling toner. Housing 64 has a front 68 toward component 60, and extends away from component 60 to a back 70 of housing 64. Housing 64, which may be one piece of molded or cast material such as plastic, generally has a top 72 and a bottom 74, as well as sides 76 (FIG. 1) and 78. Top 72, bottom 74 and sides 76 and 78 define a sealed environment for toner entering interior space 66 through an opening 80 in front 68 such that toner in interior space 66 can not leak from housing 64.

A toner separator 82 is positioned at front 68, generally in opening 80, and operates upon component 60, to dislodge toner from surface 62. In the embodiment shown, toner separator 82 includes a blade 84 having an edge 86 positioned in contact with surface 62 of toner receiving component 60. Blade 84 is attached to a blade holder 88 retained between an upwardly extending flange 90 of top 72 and a lip 92. During operation, edge 86 scrapes surface 62, to dislodge residual toner particles from surface 62. Blade 84 is made from, or coated with polyurethane or other suitable low friction, wear resistant material, and is biased against surface 62, to remain in contact therewith. Scraping implements such as blade 84 and suitable biasing or holding structures are known to those skilled in the art and will not be described in further detail herein. While a scraping implement such as blade 84 is a known, suitable device for toner separator 82, other known devices, such as brushes, may also be used for toner separator 82, and the present invention is not to be considered as limited to the use of a scraper. A suitable toner separator is one that operates in acceptable manner on the particular component 60 being cleaned, to dislodge toner particles from surface 62 of component 60.

On an opposite side of housing 64 from toner separator 82, back 70 of housing 64 forms a generally trough-like area in which an auger 94 is provided for positively transporting toner particles to a toner receptacle 96 (FIG. 1) which receives and retains the waste toner. Toner receptacle 96 is removably mounted in printing device 10, such that receptacle 96 can be removed periodically and emptied or replaced with an empty receptacle.

As shown most clearly in FIG. 2, toner separator 82 is disposed from top 72 of housing 64. A lower seal 98 is provided between a bottom flange 100 of housing 64 and surface 62 of toner receiving component 60. Bottom 74 of housing 64 further defines a surface 102 extending rearwardly and upwardly from bottom flange 100 and lower seal 98 to a top surface 104 of bottom 74. A vibration plate 108 is mounted on top surface 104, and extends rearwardly toward auger 94.

Toner separator 82 is disposed generally above, and vertically spaced from vibration plate 108 and lower seal 98, such that as blade 84 dislodges toner particles from surface 62 of toner receiving component 60, the toner falls onto vibration plate 108. Any toner accumulating between lower seal 98 and surface 102 tends to urge lower seal 98 against surface 62 of toner receiving component 60, and reduces the potential for toner particles to leak past lower seal 98.

Vibration plate 108 is disposed at an angle downwardly and rearwardly toward auger 94. To effect the downward disposition of vibration plate 108, top surface 104 can be sloped downwardly toward auger 94, and/or vibration plate 108 can be bent downwardly rearward of surface 104.

Figure 3:
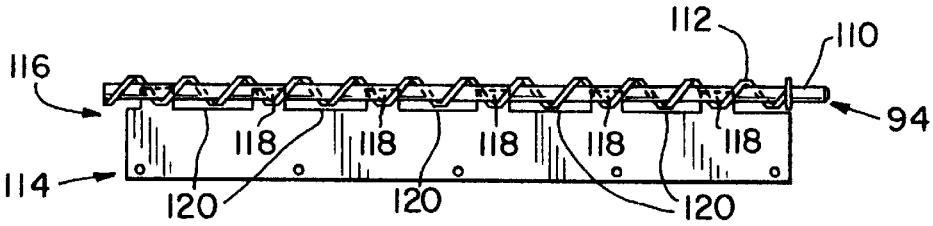
FIG. 3 is a plan view of an agitation plate and auger according to the present invention.
Figure 4:
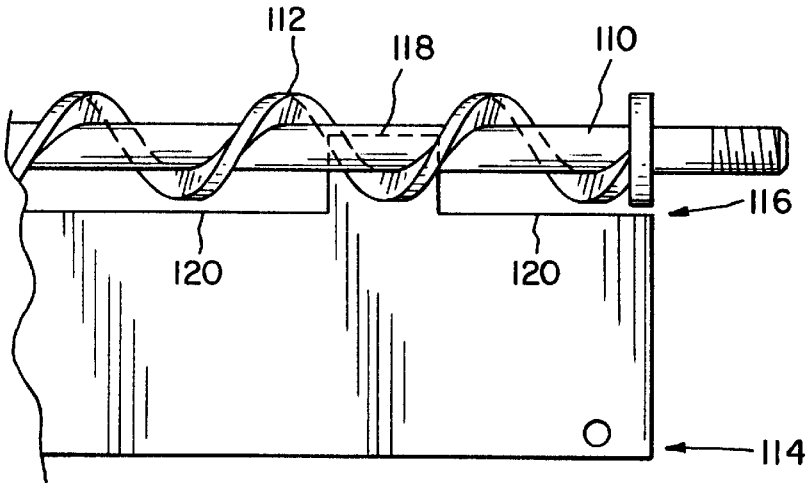
FIG. 4 is an enlarged view of a portion of the agitation plate and auger shown in FIG. 3.

Referring now to FIGS. 3 and 4, the relationship between auger 94 and vibration plate 108 will be described. Auger 94 includes a central shaft 110 and an auger flight 112 disposed thereon. Central shaft 110 is connected to drive means, not shown, for rotating shaft 110 and thus flight 112 thereon. Flight 112 is shown as a single body disposed spirally about the periphery of central shaft 110, substantially from one end of central shaft 110 to the other end thereof. However, those skilled in the art will recognize that flight 112 can be one or several flight bodies disposed about the surface of central shaft 110. Further, flight 112 may take several forms or shapes, and need not extend continuously around nor continuously along the length of central shaft 110. Flight 112 instead may have spaces and/or overlapping areas between adjacent flight bodies.

Vibration plate 108 has a receiving edge 114 disposed beneath and vertically spaced from toner separator 82. As shown in FIG. 2, vibration plate 108 is attached generally along receiving edge 114 to top surface 104, at bottom 74 of housing 64. From top surface 104, bottom 74 is angled downwardly away from vibration plate 108, so that, throughout a substantial portion of the width of vibration plate 108, vibration plate 108 is unsupported.

On the opposite side of vibration plate 108 from receiving edge 114, a discharge edge 116 is provided, and includes alternating first lengths 118 and second lengths 120 thereof. First lengths 118 extend outwardly beyond second lengths 120, defining projections or teeth that extend into auger 94. First lengths 118 extend into auger 94, and are disposed beneath central shaft 110. First lengths 118 are sufficiently long to engage central shaft 110, as will be described hereinafter. Second lengths 120, on the other hand, are disposed just short of auger flight 112, so as not to be contacted thereby, and instead to be spaced from auger 94.

In the use of a toner cleaning apparatus 12 of the present invention, toner receiving component 60 is advanced past toner cleaning apparatus 12, such that toner separator 82 operates against surface 62 of toner receiving component 60. Specifically, in the embodiment shown, blade 84 of toner separator 82 scrapes against surface 62, to dislodge residual toner particles therefrom. The dislodged toner particles fall downwardly in housing 64, and begin to accumulate along receiving edge 114 of vibration plate 108. Rotation of auger 94 causes downward deflection of vibration plate 108 as auger flight 112 contacts first lengths 118 of discharge edge 116. As flight 112 rotates along and past any one of first lengths 118, the downward deflection thereof is abruptly terminated, and that portion of vibration plate 108 snaps upwardly. The affected first length 118 engages against the surface of auger central shaft 110. Further movement is abruptly terminated thereby, and vibrations are induced in vibration plate 108. Vibrations in vibration plate 108 cause the toner accumulating on vibration plate 108 to unpack and slide toward toner auger 94. Vibration plate 108 thereby acts as a toner pump, inducing migration of toner from component 60 toward auger 94.

Toner reaching discharge edge 116 falls therefrom into auger 94. While some toner may be carried into the center of auger 94 by first lengths 118, a substantial portion of the toner will be discharged from vibration plate 108 along second lengths 120, at the periphery of auger 94.

The pumping action of vibration plate 108 reduces toner buildup inside of housing 64. Vibrations along vibration plate 108 tend to break up and distribute the toner particles, which allows for efficient handling of large dumps of toner into the cleaning system. Stress levels on system components are reduced as toner buildup is reduced. Toner is effectively conveyed away from the component being cleaned and toward the positive removal system of auger 94 and toner receptacle 96. Recontamination of the component being cleaned is reduced, and print quality is maintained.

While this invention has been described as having a preferred design, the present invention can be farther modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A toner cleaning apparatus for removing toner from a component of a printing device, said component having a surface for receiving toner particles thereon during a printing process, said toner cleaning apparatus comprising:

a toner separator operating against said component surface, to dislodge toner particles therefrom;

a toner receptacle for collecting the dislodged toner particles;

an auger for transporting dislodged toner particles to said toner receptacle; and a vibration plate disposed for receiving toner particles dislodged by said toner separator and for directing dislodged toner particles to said auger, said vibration plate including a receiving edge and a discharge edge, said discharge edge having first lengths thereof engaged by said auger, and second lengths thereof spaced from said auger.

2. The toner cleaning apparatus of claim 1, said auger having a shaft and an auger flight thereon, and said first lengths of said discharge edge engaging said shaft.

3. The toner cleaning apparatus of claim 2, said toner separator disposed above said vibration plate, and said vibration plate being vertically spaced from said toner separator.

4. The toner cleaning apparatus of claim 2, said toner separator including a blade having an edge disposed against said component.

5. The toner cleaning apparatus of claim 4, said vibration plate disposed at a downward angle from said receiving edge to said discharge edge.

6. The toner cleaning apparatus of claim 5, said blade disposed above said vibration plate, and said vibration plate being vertically spaced from said blade.

7. The toner cleaning apparatus of claim 1, said vibration plate disposed at a downward angle from said receiving edge to said discharge edge.

8. The toner cleaning apparatus of claim 7, said auger having a shaft and an auger flight thereon, and said first lengths of said discharge edge engaging said shaft.

9. The toner cleaning apparatus of claim 8, said first lengths of said discharge edge disposed beneath said shaft.

10. The toner cleaning apparatus of claim 1, said toner separator including a blade having an edge disposed against said component.

11. A method for cleaning toner from a component of a printing device, comprising:

providing a toner separator and an auger;

providing a vibration plate having a receiving edge and a discharge edge, and providing said discharge edge of said vibration plate with first portions and second portions, said second portions being nearer to said receiving edge than are said first portions;

operating said separator against said component to dislodge toner from said component;

receiving dislodged toner on said vibration plate near said receiving edge;

vibrating said vibration plate through engagement of said first portions by said auger;

discharging toner into said auger from said vibration plate along said discharge edge of said vibration plate.

12. The method of claim 11, including providing said auger with a central shaft and a flight thereon, extending said first portions of said discharge edge to engage said central shaft, rotating said auger and deflecting said discharge edge of said vibration plate with said flight while rotating said auger.

13. The method of claim 12, wherein said separator is a blade, and said operating step is performed by advancing said component past said blade and scraping said component with said blade.

14. The method of claim 11, wherein said separator is a blade, and said operating step is performed by advancing said component past said blade and scraping said component with said blade.

15. A printing device comprising:

a printing station including a printhead having a toner receiving component with a surface for receiving toner thereon;

a toner separator operating against said component surface, to dislodge toner particles therefrom;

a toner receptacle for collecting the dislodged toner particles;

an auger for transporting dislodged toner particles to said toner receptacle; and a vibration plate disposed for receiving toner particles dislodged by said toner separator and for directing dislodged toner particles to said auger, said vibration plate including a receiving edge and a discharge edge, said discharge edge having first lengths thereof engaged by said auger, and second lengths thereof spaced from said auger.

16. The printing device of claim 15, said auger having a shaft and an auger flight thereon, and said first lengths of said discharge edge engaging said shaft.

17. The printing device of claim 16, said toner separator disposed above said vibration plate, and said vibration plate being vertically spaced from said toner separator.

18. The printing device of claim 16, said toner separator including a blade having an edge disposed against said component.

19. The printing device of claim 18, said vibration plate disposed at a downward angle from said receiving edge to said discharge edge.

20. The printing device of claim 19, said blade disposed above said vibration plate, and said vibration plate being vertically spaced from said blade.

21. The printing device of claim 15, said vibration plate disposed at a downward angle from said receiving edge to said discharge edge.

22. The printing device of claim 21, said auger having a shaft and an auger flight thereon, and said first lengths of said discharge edge engaging said shaft.

23. The printing device of claim 15, said toner separator including a blade having an edge disposed against said component.

24. The printing device of claim 15, said auger having a shaft and an auger flight thereon, and said first lengths of said discharge edge disposed beneath said shaft and engaging said shaft periodically during operation.

25. The printing device of claim 15, including a housing having a top, a bottom and first and second sides, and a seal extending from said bottom to said surface.

26. The printing device of claim 25, said auger having a shaft and an auger flight thereon, and said first lengths of said discharge edge disposed beneath said shaft and engaging said shaft periodically during operation.

* * * * *